US011578924B2

(12) United States Patent
Krupa et al.

(10) Patent No.: US 11,578,924 B2
(45) Date of Patent: Feb. 14, 2023

(54) HEAT EXCHANGER

(71) Applicant: MAHLE International GmbH, Stuttgart (DE)

(72) Inventors: Andrzej Krupa, Ostrow-Wielkopolski (PL); Scott Edward Kent, Albion, NY (US); Anna Stelmasinska, Ostrow-Wielkopolski (PL); Szymon Walczak, Ostrow-Wielkopolski (PL)

(73) Assignee: MAHLE International GmbH, Stuttgart (DE)

( * ) Notice: Subject to any disclaimer, the term of this patent is extended or adjusted under 35 U.S.C. 154(b) by 130 days.

(21) Appl. No.: 16/930,363

(22) Filed: Jul. 16, 2020

(65) Prior Publication Data

US 2022/0018605 A1 Jan. 20, 2022

(51) Int. Cl.

| | |
|---|---|
| ***F28D 7/00*** | (2006.01) |
| ***F28F 1/04*** | (2006.01) |
| ***F28D 7/16*** | (2006.01) |

(52) U.S. Cl.

CPC ..... *F28D 7/0066* (2013.01); *F28F 1/04* (2013.01); *F28D 7/1669* (2013.01); *F28D 7/1676* (2013.01); *F28D 7/1684* (2013.01)

(58) Field of Classification Search

CPC .... F28D 7/0066; F28D 7/1669; F28D 7/1676; F28D 7/1684; F28F 1/04; F28F 2009/004

See application file for complete search history.

(56) References Cited

U.S. PATENT DOCUMENTS

| | | | | | |
|---|---|---|---|---|---|
| 4,357,991 | A * | 11/1982 | Cameron | F28F 9/22 | 165/910 |
| 4,836,276 | A * | 6/1989 | Yamanaka | F28D 7/1669 | 165/161 |
| 5,044,431 | A * | 9/1991 | Cameron | F28F 9/22 | 165/158 |
| 5,291,944 | A * | 3/1994 | Sanz | F28D 7/1669 | 165/910 |
| 5,355,945 | A * | 10/1994 | Sanz | F28F 9/22 | 165/910 |
| 6,808,689 | B1 * | 10/2004 | Matsumoto | C07C 45/35 | 165/161 |

(Continued)

FOREIGN PATENT DOCUMENTS

| | | | | |
|---|---|---|---|---|
| EP | 1975534 | A2 | 10/2008 | |
| JP | 2005315508 | A * | 11/2005 | F28D 7/1669 |
| WO | 92095303 | A1 | 11/2002 | |

OTHER PUBLICATIONS

Translation of Japanese Patent Document JP2005315508A entitled Translation-JP2005315508A (Year: 2005).*

*Primary Examiner* — Paul Alvare
(74) *Attorney, Agent, or Firm* — Dickinson Wright PLLC

(57) ABSTRACT

A heat exchanger (1) for thermally coupling a first fluid to a second fluid so as to transfer heat and in a fluidically separate manner includes a securing assembly (8) of two cover parts (9) and at least one, preferably a plurality of guide parts (11), through which duct tubes (5) of the heat exchanger (1) pass. The duct tubes (5) extend inside a housing tube (2) along the longitudinal axis of the housing tube (2). The first fluid passes through the housing tube (2) outside of the duct tubes (5), and the second fluid passes through the duct tubes (5). The duct tubes (5) may have circular or flattened cross-sections.

11 Claims, 4 Drawing Sheets

(56) References Cited

U.S. PATENT DOCUMENTS

| | | | | |
|---|---|---|---|---|
| 8,813,688 | B2 * | 8/2014 | Pacholski | F28D 7/10 122/15.1 |
| 9,175,883 | B2 | 11/2015 | Koberstein et al. | |
| 2004/0055740 | A1 * | 3/2004 | Meshenky | F02B 37/013 165/125 |
| 2008/0073059 | A1 * | 3/2008 | Weel | F28D 7/1692 165/51 |
| 2008/0075643 | A1 * | 3/2008 | Lv | F28F 3/12 422/201 |
| 2010/0112502 | A1 * | 5/2010 | Wunning | F23D 14/66 431/202 |
| 2012/0080172 | A1 * | 4/2012 | Pacholski | F24H 1/287 165/157 |
| 2014/0014077 | A1 * | 1/2014 | Schuricht | F28F 9/0275 165/165 |
| 2014/0262174 | A1 * | 9/2014 | Wunning | F28D 7/1676 165/158 |
| 2015/0159957 | A1 | 6/2015 | Baxi | |
| 2016/0040938 | A1 | 2/2016 | Baxi | |

* cited by examiner

HEAT EXCHANGER

TECHNICAL FIELD

The present disclosure relates to heat exchangers for thermally coupling a first fluid to a second fluid so as to transfer heat and in a fluidically separate manner.

BACKGROUND

Heat exchangers of this type have been known for a long time and serve the purpose of exchanging or of transferring, respectively, thermal energy between a first fluid and a second fluid. They can be used, for example, in vehicle applications. Generic heat exchangers are described in an exemplary manner in the documents US20150159957 A1, US20160040938 A1, U.S. Pat. No. 9,175,883 A1, EP1975534 A3 and WO2002095303 A1.

In spite of the need for more powerful, more efficient and more environmentally friendly heat exchanger solutions, the known heat exchangers have only relatively low power and, due to the frequently used all-copper material, are generally of relatively high dead weight and are unsatisfactory in terms of the burst pressure, which can be attained.

SUMMARY

The present disclosure presents an improved or at least a different embodiment of a heat exchanger.

A basic idea of the present disclosure lies in providing a heat exchanger with lower dead weight in comparison with known heat exchangers by utilizing an innovative arrangement of fluid-guiding heat exchanger components of the heat exchanger.

The heat exchanger, which serves to couple a first fluid to a second fluid so as to transfer heat and in a fluidically separate manner, has a housing tube having a longitudinal central axis of the housing tube. The housing tube can be configured so as to be hollow on the inside and annularly cylindrically, so that it limits a flow cross-section, through which fluid can flow. On two opposite free housing tube ends, the housing tube can have housing tube openings, which can each be or which are closed by advantageously welded-on housing tube covers. Nozzles, through which the first fluid can flow into or out of the housing tube, can respectively be arranged on the two housing covers. The housing tube and the housing tube covers can each consist of an aluminum material. A first flow path for the first fluid extends through the housing tube. The heat exchanger furthermore has a plurality of duct tubes, which each have a longitudinal axis of the duct tube and through which a second flow path for the second fluid leads. The duct tubes are arranged completely in the interior of the housing tube so that they extend through the first flow path for the first fluid, the first fluid can flow around the duct tubes, and the second fluid can flow through the duct tubes. Due to the fact that the first fluid is thereby thermally coupled or can be coupled to the second fluid, thermal energy can be transferred from the one fluid to the other fluid during operation of the heat exchanger. Tube nozzles, which are aligned at an angle, in particular right angle, to the longitudinal central axis of the housing tube and through which the second fluid can flow into and out of the duct tubes, can furthermore be arranged on the housing tube. A securing assembly, by means of which the duct tubes are secured to the housing tube, is provided between the housing tube and the duct tubes.

The securing assembly has two cover parts on opposite ends, respectively, through which duct tubes completely pass. The duct tubes thereby are open outside of the respective cover part by forming duct openings. The securing assembly further has at least one or a plurality of, thus at least two, guide parts, which are arranged between the two cover parts so as to be spaced along the direction of the longitudinal central axis of the housing tube and at a distance from one another, and are each completely penetrated by the duct tubes, and serve to guide the first fluid and to support the duct tubes with respect to the housing tube. This has the effect that thermal energy can be transferred relatively quickly between the fluids. This has the advantage that the heat flow between the two fluids is basically improved as compared to the solutions known since. In this manner, the performance of the heat exchanger is improved.

The heat exchanger can furthermore have at least one cross-section transverse to the longitudinal central axis of the housing tube, in which the longitudinal central axis of the housing tube defines a housing center. At least two imaginary cross-sectional circles are arranged between the housing center and the housing tube, wherein at least two duct tube pairs of two duct tubes located radially opposite one another are arranged between the two cross-sectional circles so as to be distributed around the housing center in a circumferential direction. This has the advantageous technical effect that the transfer of thermal energy, basically the heat flow, between the two fluids is further improved as compared to the solutions known since. One can thus say that the performance of the heat exchanger is improved once again.

It can furthermore be provided that a duct tube-free annular area, i.e. without duct tubes, is defined between one or an outer cross-sectional circle and the housing tube. A duct tube-free circular area can further be defined between another or an inner cross-sectional circle and the housing center. Fluid can thus flow around the duct tubes radially to the inside and radially to the outside with respect to the longitudinal central axis of the housing tube. The total weight of the heat exchanger can be reduced by creating duct tube-free areas.

At least one or all cross-sectional circles may be arranged centrically or eccentrically with respect to the housing center. The cross-sectional circles can thereby have cross-sectional circle diameters, which differ from one another.

It can furthermore be provided that flow guide plates, which serve to guide the first fluid, in particular for guiding the first fluid in a flow-efficient manner, are arranged between the duct tubes in the first flow path. The heat transfer between the first and second fluid can be further improved thereby. The flow can in particular be swirled thereby.

It can furthermore be provided that the heat exchanger has at least one cross-section, which is aligned transversely in particular with respect to the longitudinal central axis of the housing tube, in which the longitudinal central axis of the housing tube defines a housing center. At least two imaginary cross-sectional circles can thereby be arranged between the housing center and the housing tube. Between the two cross-sectional circles, at least two separate duct tube pairs can be arranged around the housing center in a circumferential direction in a circular manner and distributed spaced apart from one another. A duct tube pair can be formed of two duct tubes, which are arranged radially opposite one another with respect to the longitudinal central axis of the housing tube. Each duct tube pair thereby has a first or inner duct tube and a second or outer duct tube. The first or inner duct tubes are thereby arranged on or in the area of the radially inner or first cross-sectional circle. In the circumferential direction along the inner or first cross-sectional circle, first or inner duct tubes thus string together. The second or outer duct tubes are arranged on or in the area of the radially outer or second cross-sectional circle. In the circumferential direction along the outer or second cross-sectional circle, second or outer duct tubes thus string together. Flow guide plates for guiding the first fluid can be arranged between the first duct tubes and the second duct tubes of a duct tube pair. At least one flow guide plate can thereby be secured in a firmly bonded manner to a first or inner duct tube and to a second or outer duct tube by means of soldering. It is also conceivable that the duct tubes are soldered to the cover parts and to the guide parts. The soldering can advantageously be a soldering or welding process performed under controlled atmospheric conditions. The flow guide plate or plates can also be secured to a plurality of first or inner duct tubes and/or second or outer duct tubes.

It can furthermore be provided that exactly one second duct tube is assigned to each first duct tube. The cross-section of the first or inner duct tubes, which can be flown through, can further be configured to have a smaller surface area than the cross-section of the second or outer duct tubes, which can be flown through.

It can furthermore be provided that the heat exchanger has at least one cross-section, which is aligned transversely with respect to the longitudinal central axis of the housing tube and in which the longitudinal central axis of the housing tube defines a housing center, wherein at least two imaginary cross-sectional circle are arranged between the housing center and the housing tube. Between the two cross-sectional circles, duct tube pairs of two duct tubes located radially opposite one another can thereby be arranged so as to be distributed around the housing center in a circumferential direction, wherein the duct tubes are each configured as flat tube. The flat tubes can each have a rectangular cross-sectional area of the duct tube, which is constant along the respective longitudinal axis of the duct tube and which comprises rounded cross-sectional area of the duct tube corners. Each flat tube can have two long sides located opposite one another with respect to the longitudinal axis of the duct tube, and two short sides located opposite one another, wherein the short sides connect the long sides to one another.

It can furthermore be provided that the flat tubes are arranged between the respective cross-sectional circles in such a way that the short sides of each flat tube are in each case located opposite a short side of a flat tube, which is adjacent in the circumferential direction. It is also possible, however, to arrange the flat tubes between the respective cross-sectional circles in such a way that their long sides run perpendicular to the radial direction, which is perpendicular to the longitudinal central axis of the housing tube.

It can furthermore be provided that the housing tube, the duct tubes, the two cover parts, and the guide parts are each made of an aluminum material. These components can advantageously be soldered to one another in a firmly bonded manner and permanently as part of a soldering process performed under controlled atmospheric conditions. Due to the used aluminum material, a relatively low total weight of the heat exchanger can be attained in an advantageous manner.

The present disclosure further presents a heat exchanger comprising a housing tube having a longitudinal central axis of the housing tube for thermally coupling a first fluid to a second fluid so as to transfer heat and an in a fluidically separate manner. A first flow path for the first fluid extends through the housing tube. The heat exchanger furthermore has a plurality, i.e. at least two, duct tubes, which each define a longitudinal axis of the duct tube and through which a second flow path for the second fluid leads in each case. The duct tubes extend through the first flow path for the first fluid, so that the first fluid can flow around and the second fluid can flow through the duct tubes, so as to thus provide the function of the heat exchanger. The duct tubes are arranged, advantageously completely, in the interior of the housing tube and are each secured to the housing tube by means of a securing assembly arranged between the housing tube and the duct tubes. The securing assembly has two cover parts, through which duct tubes run in each case, wherein the latter each open out on the respective cover parts, in each case by forming duct openings. The securing assembly furthermore has a plurality of guide parts, which are arranged between the two cover parts so as to be aligned in the direction of the longitudinal central axis of the housing tube and at a distance from one another and which are each penetrated by the duct tubes, for guiding the first fluid, wherein the duct tubes are each arranged parallel to one another and distributed around the longitudinal central axis of the housing tube in a colonnade-like manner inside an imaginary cylinder tube arranged inside the housing tube in a circumferential direction. This offers the advantageous effect that the transfer of thermal energy, basically the heat flow, is improved between the two fluids as compared to the solutions known since. One can thus say that the performance of the heat exchanger is improved.

The duct tubes can each be configured integrally with a flow guide plate, thus basically formed in one piece with a flow guide plate.

This has the effect that the duct tubes and the flow guide plates can virtually not perform any relative movements to one another.

The present disclosure further presents a heat exchanger for thermally coupling a first fluid to a second fluid so as to transfer heat and in a fluidically separate manner, comprising a housing tube, wherein the housing tube having a longitudinal central axis of the housing tube, through which a first flow path for the first fluid extends. The heat exchanger also comprising a plurality of duct tubes, which each have a longitudinal axis of the duct tube and through which a second flow path for the second fluid leads in each case and which extend through the first flow path for the first fluid, so that the first fluid can flow around and the second fluid can flow through the duct tubes. Moreover, the duct tubes are arranged completely in the interior of the housing tube and are each secured to the housing tube by means of a securing assembly arranged between the housing tube and the duct tubes. The securing assembly has two cover parts, through which duct tubes pass completely in each case, wherein the duct tubes open out on the respective cover part, in each case by forming duct openings. Furthermore, the securing assembly has at least one guide part or at least one mid-guide part, which is arranged so as to be aligned between the two cover parts in the direction of the longitudinal central axis of the housing tube and at a distance from one another, and are each completely penetrated by the duct tubes, for guiding the first fluid, wherein the duct tubes in each case are realized as flat tubes. The flat tubes in each case comprising two oppositely oriented short sides and two oppositely oriented long sides, wherein the flat tubes in each case are aligned parallel to each other and parallel to the longitudinal central axis. Moreover, the flat tubes forming at least one or a plurality of tube rows, wherein the flat tubes of each tube row are arranged so that their respective long sides congruently facing each other.

It can furthermore be provided that the flat tubes of at least two tube rows are arranged so that their respective short sides are in each case arranged congruently opposite each other.

It can furthermore be provided that that the flat tubes forming two tube rows of three flat tubes in each case, wherein one short side of each flat tube of one tube row are in each case congruently arranged opposite to one short side of a flat tube of the other tube row. Advantageously, the two tube rows being flanked by two individual flat tubes so that one long side of one individual tube facing two long sides of two flat tubes of the two tube rows at one tube row end and a long side of the other individual tube facing two long sides of two other flat tubes of the two tube rows at the other tube row end.

Further important features and advantages of the present disclosure emerge from the dependent claims, from the drawings and from the associated description of the figures with reference to the drawings.

The features mentioned above and those which have yet to be explained below can be used not only in the respectively stated combination, but also in different combinations or on their own without departing from the scope of the present disclosure.

Preferred exemplary embodiments of the present disclosure are illustrated in the drawings and are explained in more detail in the description below, wherein the same reference signs refer to identical or similar or functionally identical components.

In the following, preferred embodiments of the present disclosure are described using the drawing.

DETAILED DESCRIPTION OF THE DRAWINGS

Figure 1:
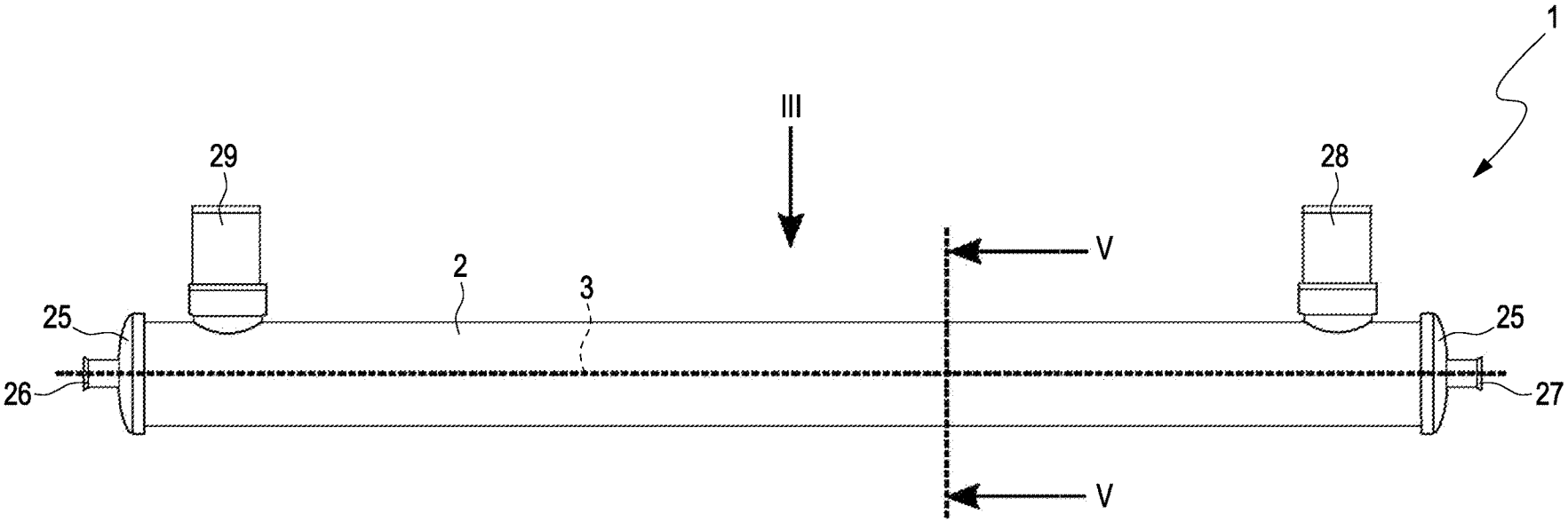
FIG. 1 shows a side view of a preferred exemplary embodiment of a heat exchanger.

FIGS. 1 to 5 show preferred exemplary embodiments heat exchangers, which are labeled as a whole with reference numeral 1, which serves to exchange or transfer, respectively, thermal energy between a first fluid and second fluid. Heat exchangers 1 of this type can be used, for example, in commercial applications, for example in vehicle application or private applications, for example in the domestic area.

FIG. 1 shows a preferred heat exchanger 1 in a side view, which has a housing tube 2, which defines a longitudinal central axis 3 of the housing tube 2 in the direction of its main expansion direction. The housing tube 2 is configured to be hollow on the inside and annularly cylindrical in an exemplary manner, so that it defines a clear flow cross-section, through which fluid can flow. On two opposite free housing tube ends, which are not identified in detail, the housing tube 2 has housing tube openings, which are not identified in more detail, which are each closed in a fluid-tight manner by means of housing tube covers 25, which are embodied in a dome-shaped manner according to FIG. 1. Nozzles 26, 27, which each extend axially along the longitudinal central axis 3 of the housing tube 2, are arranged on the two housing covers 25 in an exemplary manner, namely a cover inlet nozzle 26 on the one housing tube cover 25, and a cover outlet nozzle identified with reference numeral 27 on the other housing tube cover 25. A tube inlet nozzle 28 and a tube outlet nozzle 29, which are each aligned perpendicular to the longitudinal central axis 3 of the housing tube 2, are furthermore arranged on the housing tube 2.

Figure 2:
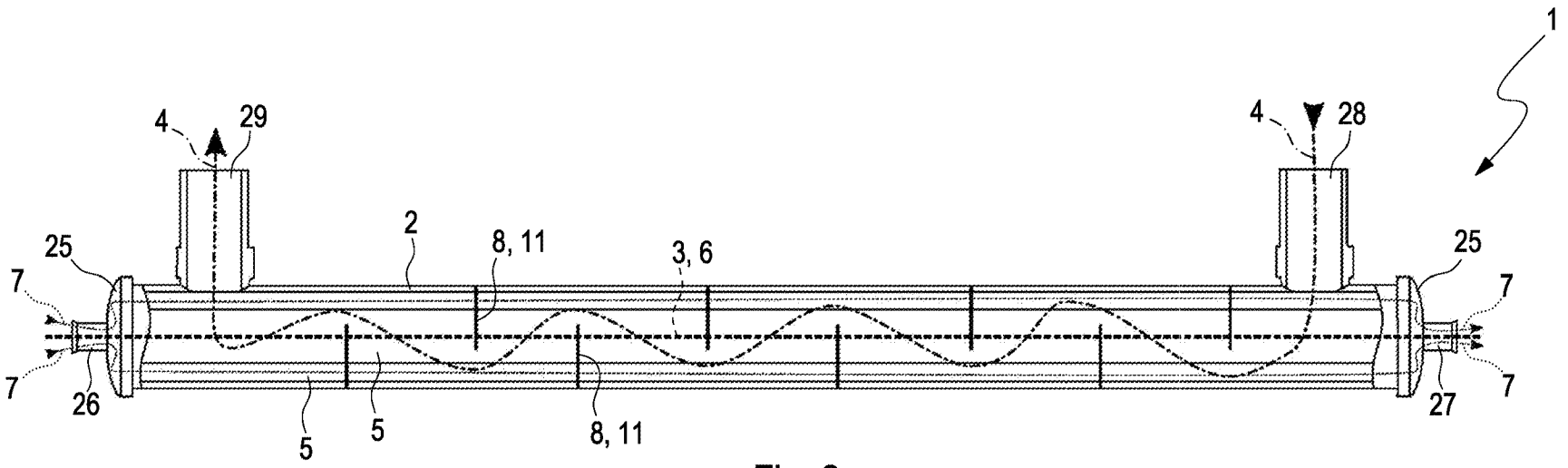
FIG. 2 shows the side view according to FIG. 1, but a housing tube of the heat exchanger is illustrated in a cut manner, so as to reveal a view into the interior of the heat exchanger.

Two flow paths 4, 7, which each extend through the housing tube 2 and which are suggested by means of dotted or dash-dotted lines, respectively, can be seen according to FIG. 2. In the shown example, the first flow path 4 illustrates the flow path of the first fluid, and the second flow path 7 illustrates the flow path of the second fluid. The first fluid flows through the tube inlet nozzle 28 into the housing tube 2, along the flow path 4 through the housing tube 2, and lastly through the tube outlet nozzle 29 out of the housing tube 2. In an exemplary manner, the first fluid can flow into the housing tube 2 on the tube inlet nozzle 28 with a relatively low temperature, and, after a transfer of thermal energy between the fluids, can flow out downstream through the tube outlet nozzle 29 with a relatively high temperature. The second fluid can flow through the cover inlet nozzle 26 into the housing tube 2, along the flow path 7 in the direction of the longitudinal central axis 3 of the housing tube 2 through the housing tube 2, and can flow through the cover outlet nozzle 27 out of the housing tube 2. In the shown example, the second fluid can flow into the housing tube 2 on the cover inlet nozzle 26 with a relatively high temperature, and, after a transfer of thermal energy between the fluids, can flow out downstream through the cover outlet nozzle 27 with a relatively low temperature. In the shown example, the first and second fluid can each be a refrigerant. In one example, the fluids may flow through the housing 2 in the same direction along the flow paths 4, 7. In the present case, however, it is illustrated that the fluids flow through the housing 2 in opposite directions.

To functionally attain in the case of the present heat exchanger 1 that thermal energy is transferred from the first fluid to the second fluid, or vice versa, without the fluids mixing with one another, it is provided that the first fluid and the second fluid are thermally coupled to one another so as to transfer heat and in a separate manner. This is attained in that a plurality of duct tubes 5, which each define a longitudinal axis of the duct tube 6, are arranged in the interior of the housing tube 2, wherein the second flow path 7 for the second fluid in each case advantageously leads through the duct tubes 5 on the inside, while the first flow path 4 for the first fluid leads around the duct tubes 5 on the outside. It is thus ensured that the first fluid can flow around and the second fluid can flow through the duct tubes 5. The fluids are thus coupled in a separate manner. During operation of the heat exchanger 1, the advantage is thus attained that thermal energy can be transferred or exchanged between the fluids.

It can further be seen from FIG. 2 that the duct tubes 5, which are arranged in the interior of the housing tube 2, are each secured to the housing tube 2 by means of a securing assembly 8 arranged between the housing tube 2 and the duct tubes 5. In an exemplary manner, the securing assembly 8 has two cover parts 9, which are spaced apart from one another in the direction of the longitudinal central axis 3 of the housing tube 2 and which are illustrated in an exemplary manner in FIG. 3. The duct tubes 5 in each case pass through the cover parts 9 completely. The duct tubes 5 each open out on the respective cover part 9 by forming a duct opening 10. The duct openings 10 of the one cover part 9 and the duct openings 10 of the other cover part 9 are aligned opposite one another in the direction of the longitudinal central axis 3 of the housing tube 2, see FIG. 3. In addition to the two over parts 9, the securing assembly 8 has at least one, preferably a plurality of, guide parts 11, which are arranged between the two cover parts 9 so as to be aligned in the direction of the longitudinal central axis 3 of the housing tube 2 and so as to be spaced apart from one another in each case, see FIGS. 2 and 3. In an exemplary manner, the duct tubes 5 each penetrate completely through the guide parts 11, that is, the duct tubes 5 pass completely through the guide parts 11 in each case. The guide parts 11 have the purpose of guiding the fluid flowing through the housing tube 2, for example the first fluid, in a flow-efficient manner, which is suggested in FIG. 2 by means of a wave-shaped course of the flow path 4.

Figure 3:
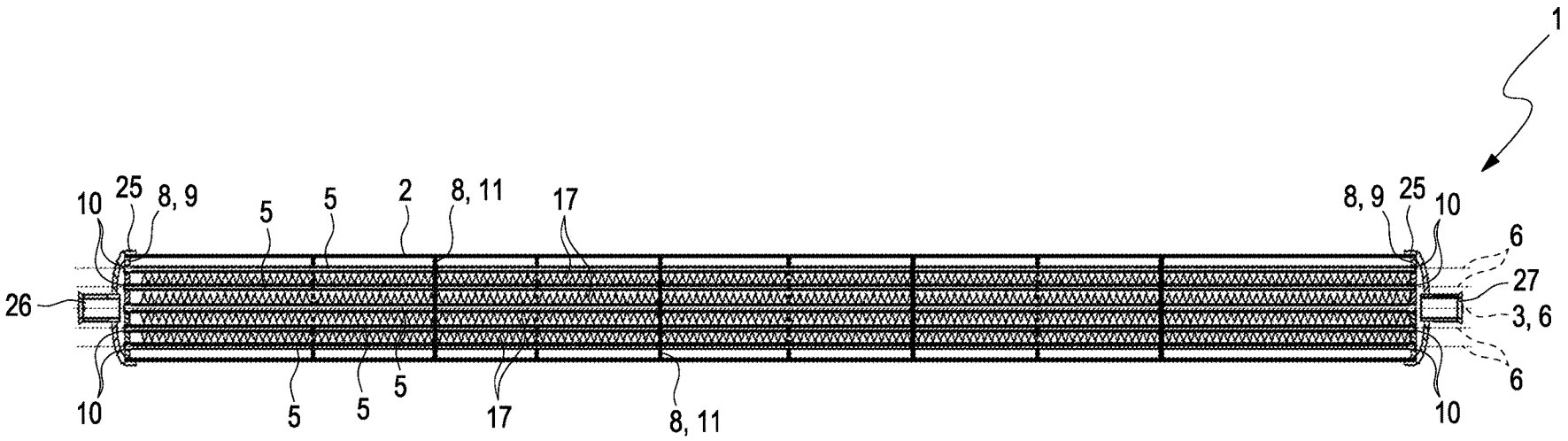
FIG. 3 shows a sectional view of the heat exchanger from FIG. 1 according to the sectional line illustrated therein by means of dashes, with view in the direction of an illustrated arrow III.

A sectional view of the heat exchanger 1 from FIG. 1 is illustrated in FIG. 3, wherein flow guide plates 17 for flow-efficiently guiding the first fluid can in particular be seen between the duct tubes 5, which are arranged in the housing 2, inside the first flow path 4. By means of flow-efficiently guiding the first fluid, the flow guide plates 17 can advantageously promote the transfer of thermal energy from the first fluid to the second fluid or from the second fluid to the first fluid. In an exemplary manner, the flow guide plates 17 can thereby be arranged between the duct tubes 5 in the shape of a zig-zag. In an exemplary manner, the flow guide plates 17 can be secured to the duct tubes 5 by means of soldering.

Figure 4:
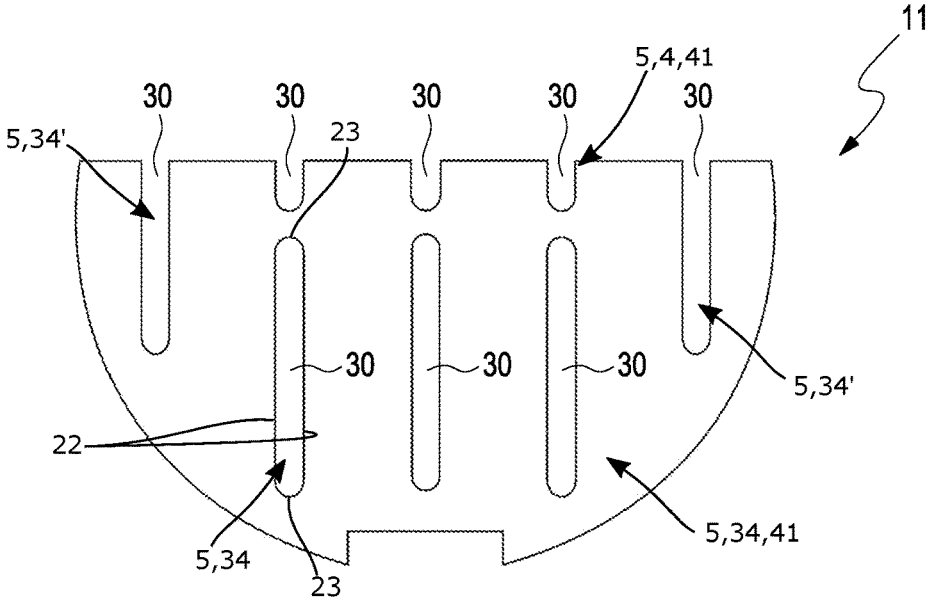
FIG. 4 shows a front view onto a guide part of the heat exchanger from FIG. 1.

In an exemplary manner, FIG. 4 shows one of the described guide parts 11 of the securing assembly 8 in a front view, so as to show that the guide part 11 has duct tube passages 30 at the locations, where it is penetrated by duct tubes 5. The duct tube passages 30 pass through the guide part 11 completely. In an exemplary manner, a cross-sectional area of a duct tube passage 30 is virtually identical to a cross-sectional area 15 of the duct tube of a duct tube 5, which will be described in more detail below. The duct tubes 5 can thereby each protrude through the duct tube passages 30 of the respective guide part 11 without play. In the installed state, the guide part 11 limits only a predetermined or predeterminable portion, for example 66%, of the clear flow cross-section of the housing tube 2 in an exemplary manner.

In FIG. 4 one can also see, even if it is not explicitly shown, that the duct tubes 5 in each case are realized as flat tubes 34. The flat tubes 34 in each case comprising two oppositely oriented short sides 23 and two oppositely oriented long sides 22, wherein the flat tubes 34 in each case are aligned parallel to each other and parallel to the longitudinal central axis 3. The flat tubes 34 thereby forming two tube rows 41 each consisting of three flat tubes 34. The flat tubes 34 of each tube row 41 are arranged so that their respective long sides 22 congruently facing each other. Furthermore the flat tubes 34 of both tube rows 41 are arranged so that their respective short sides 23 are in each case arranged congruently opposite each other. Moreover, the two tube rows 41 being flanked by two individual flat tubes 34' so that one long side 22 of one individual tube 34' facing two long sides 22 of two flat tubes 34 of the two tube rows 41 at one tube row end. Also a long side 22 of the other individual tube 34' facing two long sides 22 of two other flat tubes 34 of the two tube rows 41 at the other tube row end.

Figure 5:
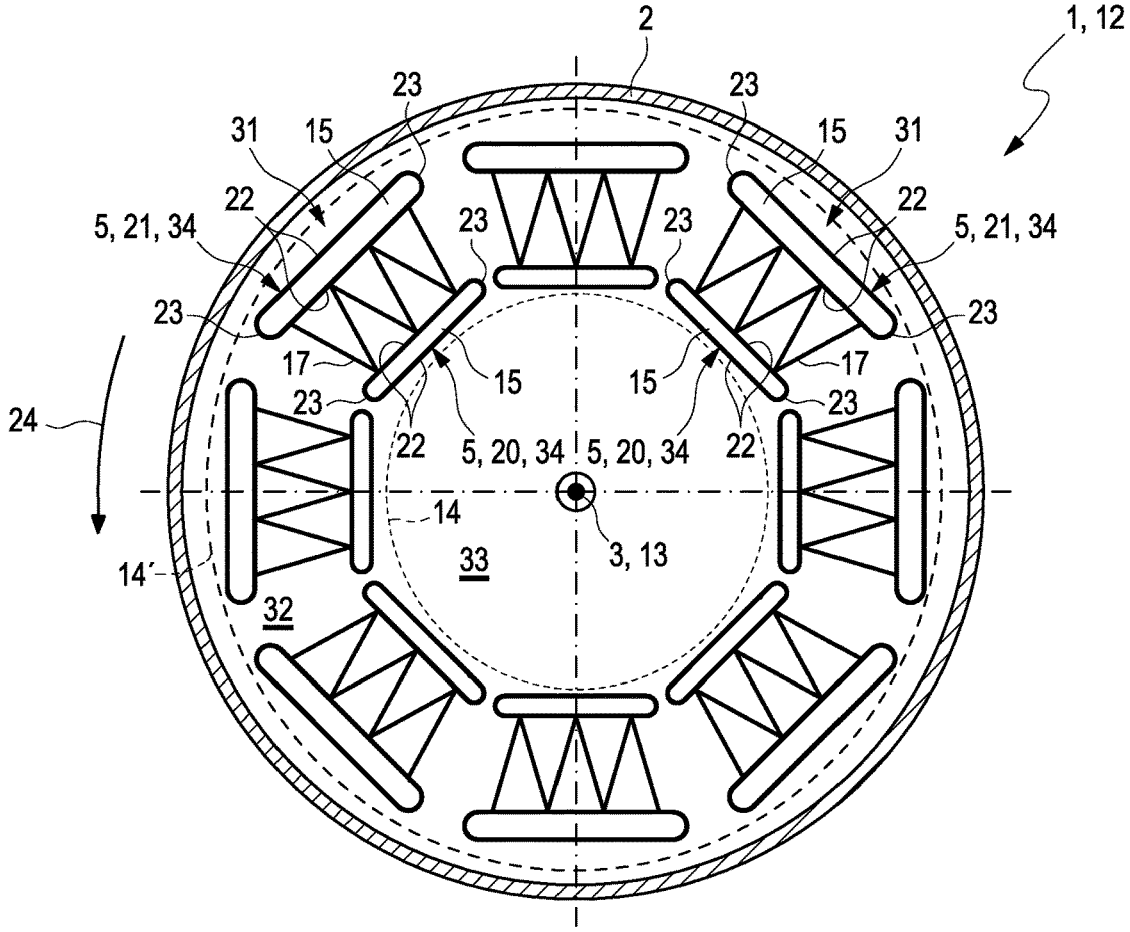
FIG. 5 shows a cross-section of another heat exchanger according to FIG. 1 viewed from sectional line V-V illustrated therein by means of dashes.

A cross-section 12 of another heat exchanger 1 according to FIG. 1 is illustrated in FIG. 5 viewed from sectional line V-V, which is illustrated therein by means of dashes. The cross-section 12 has a housing center 13, which is defined by the longitudinal central axis 3 of the housing tube 2 and which is suggested in an exemplary manner in FIG. 5 by means of a circle. Two imaginary cross-sectional circles 14, 14', which are aligned centrically with respect to the housing center 13, are arranged between the housing center 13 and the housing tube 2, wherein the radially inner first cross-sectional circle 14 with respect to the housing center 13 has a smaller diameter than the radially outer second cross-sectional circle 14' with respect to the housing center 13. The two cross-sectional circles 14, 14' are each suggested by means of a dashed line, so that a duct tube-free annular area 32, which is arranged between the outer cross-sectional circle 14' and the housing tube 2, and a duct tube-free circular area 33, which is arranged between the other inner cross-sectional circle 14 and the housing center 13, can also be seen. The annular area 32 is basically a cross-sectional area of a duct tube-free annular area, which extends through the entire housing tube 2. Fluid can flow from the duct tubes 5 in an unhindered manner here. Analogous to the annular area 32, the circular area 33 is basically a cross-sectional area of a duct tube-free circular cylindrical area, which extends through the entire housing tube 2. Fluid can flow from the duct tubes 5 in an unhindered manner here.

Between or in the area of the two cross-sectional circles 14, 14', a plurality of duct tube pairs 31 are arranged so as to be distributed around the housing center 13 in a circumferential direction 24. The duct tube pairs 31 are spaced apart from one another in the circumferential direction 24. The duct tube pairs 31 each have two duct tubes 5 located radially opposite one another, namely a radially inner first duct tube 20 with respect to the housing center 13, as well as a radially outer second duct tube 21 with respect to the housing center 13. This has the advantage that a flow of the first fluid around the duct tubes 5 is ensured here.

It can also be seen in FIG. 5 that the duct tubes 5, 20, 21 are each configured as flat tubes 34, which can each have a constant cross-sectional area 15 of the duct tube, which is planar along the respective longitudinal axis of the duct tube 6. Each cross-sectional area 15 of the duct tube is preferably configured to be rectangular and is configured with rounded cross-sectional area of the duct tube corners. Each cross-sectional area 15 of the duct tube advantageously defines a cross-section, which can be flown through. In an exemplary manner, the cross-section of the first duct tubes 20, which can be flown through, can have a smaller surface area than the cross-section of the second outer duct tubes 21, which can be flown through. It can also be seen in FIG. 5 that the flat tubes 34 of the duct tubes 5, 21, 22 each have two long sides 22 located opposite one another with respect to the respective longitudinal axis of the duct tube 6, and two short sides 23 located opposite one another. The long sides 22 are thereby basically connected to one another via the short sides 23. The long sides 22 or the short sides 23 of all duct tubes 5, 20, 21 can be aligned parallel or angular to one another. The flat tubes 34 can furthermore be aligned in such a way that their long sides 22 run perpendicular to the radial direction, which is perpendicular to the longitudinal central axis 3 of the housing tube 2. The short sides 23 of each flat tube 34 are thereby each located opposite a short side 23 of a flat tube 34, which is adjacent in the circumferential direction 24. In the alternative, all long sides 22 of the flat tubes 34 can be aligned parallel to one another, as it is suggested in FIG. 5 by means of dotted cross-sectional area of the duct tubes 15.

It can furthermore be seen in FIG. 5 that flow guide plates 17 for guiding the first fluid in a flow-efficient manner are arranged between the first and second duct tubes 5, 20, 21. The flow guide plates 17 can advantageously promote the transfer of thermal energy from the first fluid to the second fluid or from the second fluid to the first fluid. In an exemplary manner, the flow guide plates 17 can preferably be arranged between the duct tubes 5, 20, 21 of a duct tube pair 31 in the shape of a zig-zag. In the alternative, the flow guide plates 17 can preferably be arranged between the duct tubes 5, 20, 21 of a plurality of duct tube pairs 31 in the shape of a zig-zag.

Figure 6:
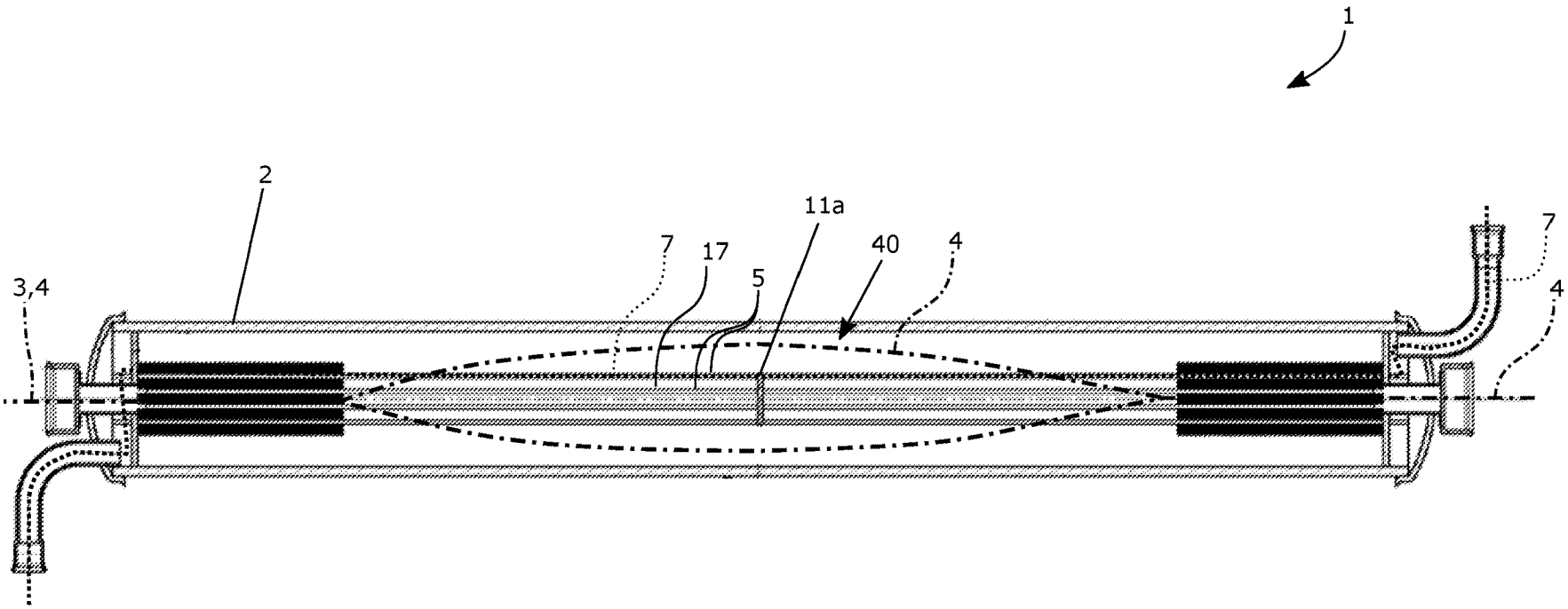
FIG. 6 shows in a sectional side view of a further preferred embodiment of a heat exchanger.

FIG. 6 shows a sectional side view of a further preferred embodiment of a heat exchanger, which is also labeled with reference numeral 1. Also this heat exchanger 1 is preferred to be used, for example, in commercial applications, for example in vehicle application or private applications, for example in the domestic area.

As shown in FIG. 6, two flow paths 4, 7, which each extend through the housing tube 2 of this heat exchanger 1, are indicated by dotted or dash-dotted lines. The first flow path 4 for the first fluid leads around the duct tubes 5. The second flow path 7 for the second fluid leads through the duct tubes 5. By this, it is ensured that the first fluid flows outside of and the second fluid flows inside the duct tubes 5. In contrast to the previous embodiment the first fluid flows in from the top of the heat exchanger 1, relative to gravity, and is for example directed to an outer area 40 of the housing tube 2 by only one guide part 11. The first fluid thereby traveling through flow guide plates 17 attached to the duct tubes 5. This guide part 11 is realized as a partial-width mid-guide part 11*a*, which acts like a deflector plate. The mid-guide part 11*a* is exemplarily placed exactly in the longitudinal center of the housing tube 2, so that it defines two halves. Furthermore, the mid-guide part 11*a* is supported by the duct tubes 5, for example the mid-guide part 11*a* is soldered to the duct tubes 5. As one can see, the mid-guide part 11*a* is located centrally regarding the longitudinal central axis 3. The mid-guide part 11*a* can also be spaced from the housing tube 2 all around, so that the mid-guide part 11*a* is carried exclusively by the duct tubes 5. Between the duct tubes 5, offset strip centers are stacked. At the bottom of the heat exchanger 1, relative to gravity, the first fluid flow must go back to an inner area of the housing tube 2 to exit. The first fluid thereby traveling through flow guide plates 17 again.

While the above description constitutes the preferred embodiments of the present invention, the invention is susceptible to modification, variation and change without departing from the proper scope and fair meaning of the accompanying claims.

What is claimed is:

1. A heat exchanger for thermally coupling a first fluid to a second fluid so as to transfer heat and in a fluidically separate manner, the heat exchanger comprising:

a housing tube (2) having a longitudinal central axis (3), through which a first flow path (4) for the first fluid extends, a plurality of duct tubes (5), which each have a longitudinal axis (6) and defining a second flow path (7) for the second fluid, the plurality of duct tubes extending through the first flow path (4) for the first fluid, to allow the first fluid to flow around the duct tubes outside of the duct tubes and to allow the second fluid to flow through the duct tubes (5) inside the duct tubes, and flow guide plates (17) for guiding the first fluid between the duct tubes (5) in the first flow path (4), wherein the duct tubes (5) are arranged completely inside the housing tube (2) and are each secured to the housing tube (2) by a securing assembly (8) arranged between the housing tube (2) and the duct tubes (5), wherein the securing assembly (8) has two cover parts (9) near opposite ends of the housing tube, respectively, through which duct tubes (5) pass, wherein each of the duct tubes (5) has open ends longitudinally outward from the cover parts (9), respectively, thereby forming duct openings (10), and wherein the securing assembly (8) has at least one guide part (11), which is arranged longitudinally between the two cover parts (9) at a distance from the cover parts, and completely penetrated by the duct tubes (5), for guiding the first fluid;

wherein the heat exchanger (1) has at least one cross-section (12) transverse to the longitudinal central axis (3) of the housing tube and in which the longitudinal central axis (3) of the housing tube defines a housing center (13), wherein at least two imaginary cross-sectional circles (14, 14') are arranged between the housing center (13) and the housing tube (2), wherein duct tube pairs (31) of two duct tubes (5) located radially opposite one another are arranged between an inner imaginary cross-sectional circle and an outer imaginary cross-sectional circle of the at least two imaginary cross-sectional circles (14, 14') so as to be distributed around the housing center (13) in a circumferential direction (24), wherein first duct tubes (20) are circumferentially distributed on the inner cross-sectional circle (14) around the housing center (13) and second duct tubes (21) are circumferentially distributed on the outer cross-sectional circle (14') around the housing center (13), wherein the flow guide plates (17) for guiding the first fluid are arranged between the first duct tubes (20) and the second duct tubes (21), wherein at least one flow guide plate (17) is soldered to at least one of the first duct tubes (20) and to at least one of the second duct tubes (21);

wherein exactly one of the second duct tubes (21) is respectively assigned to each first duct tube (20), such that the flow guide plates are arranged in the shape of a zig-zag.

2. The heat exchanger according to claim 1, wherein the heat exchanger (1) has at least one cross-section (12) centered around the longitudinal central axis (3) of the housing tube and in which the longitudinal central axis (3) of the housing tube defines a housing center (13), wherein at least two imaginary cross-sectional circles (14, 14') are arranged between the housing center (13) and the housing tube (2), wherein at least two duct tube pairs (31) of two duct tubes (5) located radially opposite one another are arranged between the two cross-sectional circles (14, 14') so as to be distributed around the housing center (13) in a circumferential direction (24).

3. The heat exchanger according to claim 2, wherein one of the at least two imaginary cross-sectional circles is an outer cross-sectional circle and another one of the at least two imaginary cross-sectional circles is an inner cross-sectional circle, wherein a duct tube-free annular area (32) is defined between the outer cross-sectional circle (14') and the housing tube (2), and wherein a duct tube-free circular area (33) is defined between the inner cross-sectional circle (14) and the housing center (13).

4. The heat exchanger according to claim 2, wherein at least one of the at least two cross-sectional circles (14, 14') is arranged centrically with respect to the housing center (13), wherein the cross-sectional circles (14, 14') have cross-sectional circle diameters, which differ from one another.

5. The heat exchanger according to claim 1, wherein an inner cross-section of the first duct tubes (20) is smaller than an inner cross-section of the second duct tubes (21).

6. The heat exchanger according to claim 1, wherein the duct tubes (5) are soldered to the cover parts (9) and to the at least one guide part (11).

7. The heat exchanger according to claim 1, wherein the housing tube (2), the duct tubes (5), the two cover parts (9), and the at least one guide part (11) are all made of an aluminum material.

8. The heat exchanger according to claim 1, wherein the housing tube (2), the duct tubes (5), the two cover parts (9), and the guide parts (11) are all made of an aluminum material and are soldered to one another in a firmly bonded manner as part of a soldering process performed under controlled atmospheric conditions.

9. The heat exchanger according to claim 1, wherein each of the duct tubes (5) is configured as a flat tube (34) and has a rectangular cross-sectional area, which is constant along the longitudinal axis (6) of the duct tube and which comprises rounded cross-sectional areas of duct tube corners, wherein each flat tube (34) has two long sides (22) located opposite one another with respect to the longitudinal axis (6) of the duct tube, and two short sides (23) located opposite one another, which connect the long sides (22) to one another.

10. The heat exchanger according to claim 9, wherein, the flat tubes (34) are arranged between the cross-sectional circles (14, 14') in such a way that each of the short sides (23) of each of the flat tubes (34) faces the short side (23) of a circumferentially adjacent flat tube (34).

11. The heat exchanger according to claim 9, wherein the flat tubes (34) are arranged between the respective cross-sectional circles (14, 14') in such a way that the long sides (22) of the flat tubes extend tangentially with respect to the housing center (13).

* * * * *